US011498710B2

(12) United States Patent
Stadler

(10) Patent No.: US 11,498,710 B2
(45) Date of Patent: Nov. 15, 2022

(54) METHOD AND APPARATUS USED TO CLOSE EXTERNAL CARDBOARD PACKAGINGS

(71) Applicant: KRONES Aktiengesellschaft, Neutraubling (DE)

(72) Inventor: Thomas Stadler, Kolbermoor (DE)

(73) Assignee: KRONES Aktiengesellschaft, Neutraubling (DE)

( * ) Notice: Subject to any disclaimer, the term of this patent is extended or adjusted under 35 U.S.C. 154(b) by 464 days.

(21) Appl. No.: 16/394,703

(22) Filed: Apr. 25, 2019

(65) Prior Publication Data

US 2019/0337649 A1 Nov. 7, 2019

(30) Foreign Application Priority Data

May 3, 2018 (DE) ..... 10 2018 110 639.4

(51) Int. Cl.
*B65B 7/20* (2006.01)

(52) U.S. Cl.
CPC ..... *B65B 7/20* (2013.01)

(58) Field of Classification Search
None
See application file for complete search history.

(56) References Cited

U.S. PATENT DOCUMENTS 2,439,435 A 4/1948 Richardson et al.
2,575,544 A * 11/1951 Zinn, Jr. ..... B29C 66/1122 53/484
3,248,039 A 4/1966 Locke
3,280,535 A * 10/1966 Reimers ..... B65B 7/18 53/371.8

(Continued)

FOREIGN PATENT DOCUMENTS

DE 102015122901 A1 6/2017
GB 333543 A 8/1930

(Continued)

OTHER PUBLICATIONS

Patent Application DE 10 2018 110 639.4 filed May 13, 2018—German Search Report dated Jan. 4, 2019.

(Continued)

*Primary Examiner* — Hemant Desai
*Assistant Examiner* — Tanzim Imam
(74) *Attorney, Agent, or Firm* — Simmons Perrine Moyer Bergman PLC

(57) ABSTRACT

The invention relates to a method and an apparatus (22) for closing the top side of external cardboard packagings (1). The external cardboard packagings (1) comprise two top closing flaps (3, 4) located opposite each other. Side edges (42) of the closing flaps (3, 4) are connected to each other via two fold-in flaps (5, 6). During closing, at least two external cardboard packagings (1) are positioned in a group (50) contiguous to each other or slightly spaced apart. At least two folding devices (23) are advanceable toward each other to engage the fold-in flaps (5, 6) of each of the at least two external cardboard packagings (1), thus pressing the fold-in flaps (5, 6) toward each other and folding them over their particular second fold edges (60) and third fold edges (7), thereby folding down the top closing flaps (3, 4).

11 Claims, 5 Drawing Sheets

(56) References Cited

U.S. PATENT DOCUMENTS

| | | | | | |
|---|---|---|---|---|---|
| 3,319,398 | A * | 5/1967 | Vadas | B29C 66/82263 53/370.6 |
| 3,645,068 | A * | 2/1972 | Langen | B65B 5/08 53/566 |
| 4,078,364 | A * | 3/1978 | Schmidt | B65B 7/18 493/184 |
| 4,215,522 | A * | 8/1980 | Clift | B65B 7/20 53/370.6 |
| 4,738,077 | A * | 4/1988 | Wakbayashi | B65B 7/18 53/372.7 |
| 5,234,398 | A * | 8/1993 | Larsen | B31B 50/30 493/183 |
| 5,634,323 | A * | 6/1997 | Podsiadlo | B65B 7/18 493/184 |
| 5,839,254 | A | 11/1998 | Chen | |
| 6,668,525 | B2 * | 12/2003 | Toth | B65B 7/20 53/136.4 |
| 7,500,594 | B1 * | 3/2009 | Toth | B65D 5/4266 229/137 |
| 2004/0198576 | A1 | 10/2004 | Toth et al. | |
| 2016/0297560 | A1 | 10/2016 | Toth | |

FOREIGN PATENT DOCUMENTS

| | | | |
|---|---|---|---|
| GB | 1057262 | A | 2/1967 |
| JP | 2015058937 | A | 3/2015 |
| JP | 6127858 | B2 | 5/2017 |

OTHER PUBLICATIONS

Priority Application DE 10 2018 110 639.4 filed May 3, 2019—Extended European Search Report (EESR) dated Sep. 12, 2019.
Chinese Office Action dated Sep. 25, 2020.

* cited by examiner

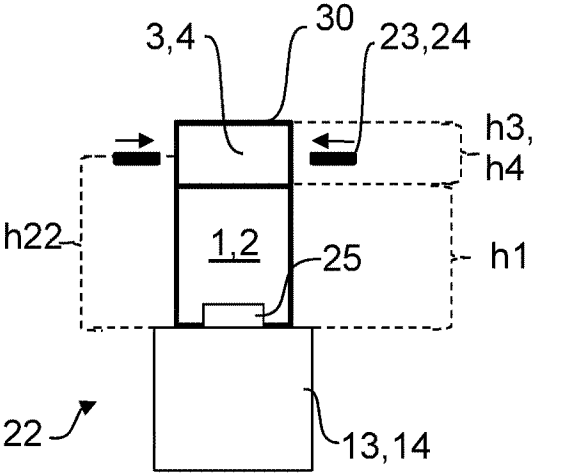
Fig. 3B
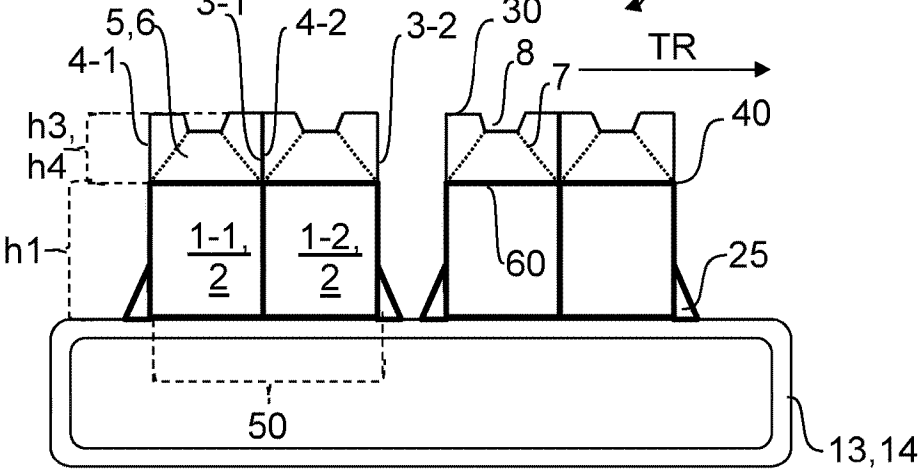
Fig. 3A
Fig. 4B
Fig. 4A

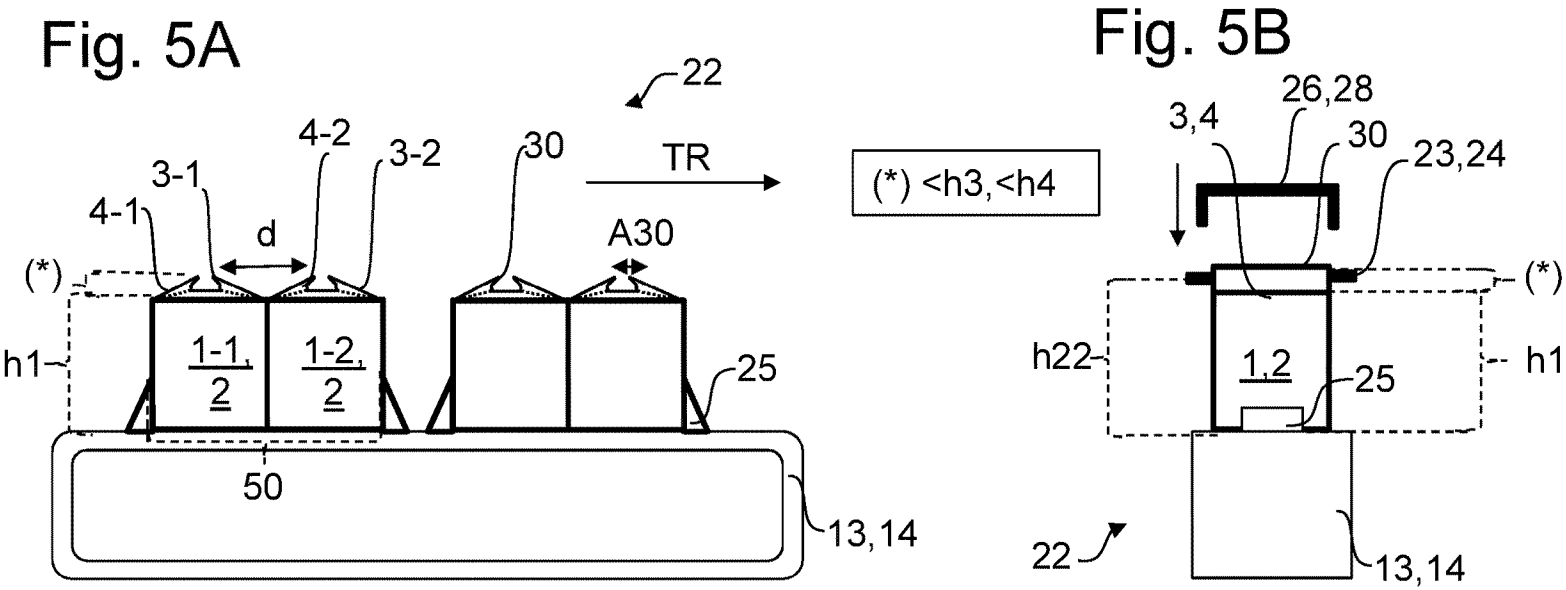
Fig. 5A
Fig. 5B
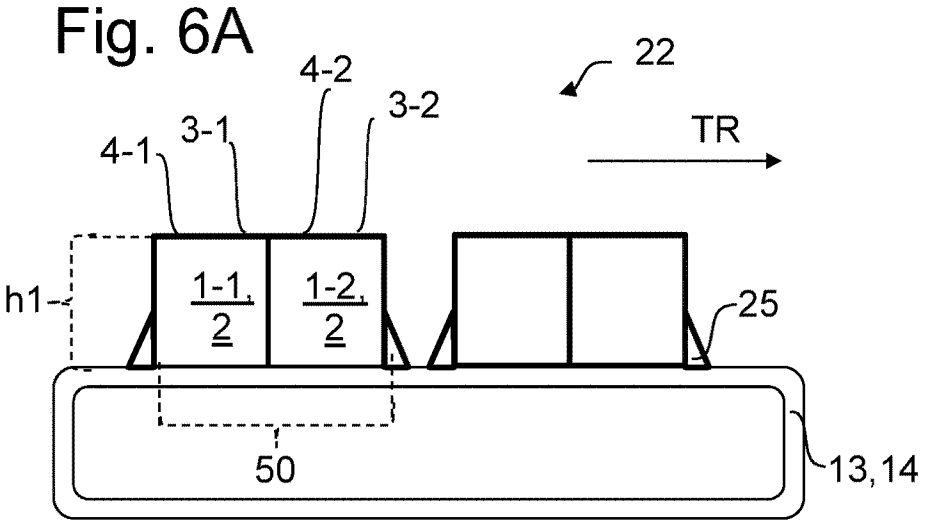
Fig. 6A
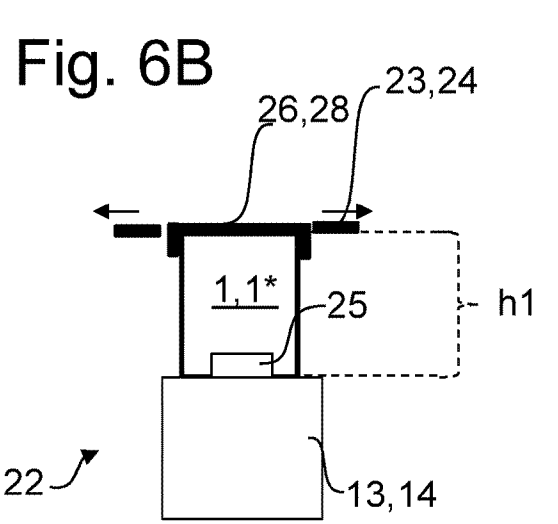
Fig. 6B

METHOD AND APPARATUS USED TO CLOSE EXTERNAL CARDBOARD PACKAGINGS

CLAIM OF PRIORITY

The present application claims priority to German Application 10 2018 110 639.4, filed May 3, 2018, which is incorporated by reference.

FIELD OF THE INVENTION

The present invention relates to a method and an apparatus according to the features of the independent claims, the method and the apparatus being used to close external cardboard packagings.

BACKGROUND OF THE INVENTION

The invention relates to the closing of external cardboard packagings. Customarily known RSC boxes, that is, collapsible boxes with four closing flaps, are closed by first folding in the inside flaps with the aid of inside flap folding-in means or the like, and, subsequent thereto, likewise folding in the outside flaps with the aid of top flap folding-in means. Between the folding in of the inside flaps and the folding in of the outside flaps, an application of adhesive onto the outer sides of the inside flaps or onto the inner sides of the outside flaps can be carried out, for example, such that a fixing of the outer flaps to the inner flaps can additionally be performed when folding in the outer flaps. In order to securely close the external cardboard packaging, an adhesive strip, for example, can also be alternatively applied over the abutting edge between the two outside flaps subsequent to the procedure of folding in the outside flaps.

The invention relates, in particular, to the closing of external cardboard packagings that are specifically designed, in particular in the lower section, as customary RSC boxes. The upper section is by contrast designed as quick-closing system comprising two closing flaps connected to each other via fold-in flaps. Such an external cardboard packaging is described, for example, in patent document U.S. Pat. No. 6,668,525 B2 and illustrated in FIG. 1. The document also describes an apparatus used to close such external cardboard packagings. The apparatus comprises a V-shaped centering device above a conveyor apparatus for external cardboard packagings that are expanded and already closed in the bottom section. During transport via the conveyor apparatus, the external cardboard packagings first enter the central opening of the V formed between the arms of the centering device. During the further movement in conveying direction, the arms of the centering device contact the top flaps of the external cardboard packaging. By further approach of the arms of the V toward each other, the closing flaps of the external cardboard packaging are pressed downward, thereby causing the fold-in flaps to fold in.

The disadvantages are that both when closing the customary RSC boxes and when closing the specifically designed external cardboard packagings according to patent document U.S. Pat. No. 6,668,525 B2, it is only possible to process one external cardboard packaging per conveyor lane because the closing tools require a certain amount of space. In particular in the known apparatuses for closing customary RSC boxes, it is always only possible to process a defined size of boxes because the lane width and the arrangement of the folding-in tools have to be specifically adapted.

It is the object of the invention to provide an apparatus and a method with an improved performance to use for closing external cardboard packagings.

The above object is solved by an apparatus, in particular a folding apparatus, used to close external cardboard packagings and a method used to close external cardboard packagings, which apparatus and method comprise the features of the independent claims. Further advantageous embodiments of the invention are described in the subclaims.

SUMMARY OF THE INVENTION

The method and the apparatus are provided, in particular, for external cardboard packagings with the bottom sides designed as customary RSC boxes, that is, for the so-called regular slotted carton, which is assembled in the known manner from a suitable box blank and closed on the bottom side. The top side, by contrast, is provided with a quick-closing system. In particular, the external cardboard packagings described here comprise two top closing flaps located opposite each other and foldable over approximately horizontal first fold edges, with the side edges of the closing flaps being in each instance connected to each other via two fold-in flaps.

The fold-in flaps each likewise have an approximately horizontal second fold edge and additional diagonal third fold edges, with the diagonal third fold edges being formed in each instance, in particular, between the endpoints of the second horizontal fold edge of the fold-in flap and the center of a parallelly formed top free edge of the fold-in flap. Also, the diagonal third fold edges may be between the endpoints of the second horizontal fold edge of the fold-in flap and the parallelly formed top free edge of the fold-in flap so as to create a trapezoidal shape for the fold-in flaps.

The external cardboard packagings are unfolded in the known manner, closed at the bottom and filled with suitable contents, for example with a set of articles of a defined number of the same or of different articles. The articles can be filled beverage containers, for example, such as bottles or cans or other suitable products to be packaged. The filled box then has to be closed at the top side in order to complete the external packaging.

In order to carry out a closing procedure according to the method described here, at least two external cardboard packagings are positioned as group directly contiguous to each other or slightly spaced apart such that a first top closing flap of a first external cardboard packaging of the group is located directly contiguous to or slightly spaced apart from a second top closing flap of a second external cardboard packaging of the group. Such a group is positioned and/or disposed, in particular, on a transport device of the apparatus according to the invention.

For each of the at least two external cardboard packagings of the group, the apparatus furthermore comprises in each instance at least two folding devices that are advanceable toward each other. The folding devices are formed to be linearly movable transversely to a transport direction of the transport device, and they engage with, e.g. are brought into engagement with, the fold-in flaps of the external cardboard packagings in order to close the external cardboard packagings. In particular, in each instance two folding devices that are advanceable toward each other and bear on the fold-in flaps of each of the at least two external cardboard packagings of the group, press the fold-in flaps toward each other, whereby the fold-in flaps are folded over at their particular second and third fold edges and pressed inward, thus causing the top closing flaps to fold down.

The top side surface of the closed external cardboard packaging is formed by at least one top closing flap. According to one embodiment of the invention, the closing flaps can have, for example, largely identical dimensions, and, in particular, they can have a width between the horizontal fold edge and a free parallel edge that in each instance approximately corresponds to half of the width of the top side of the external cardboard packaging between the two horizontal fold edges of the top closing flaps; preferably, the width between the horizontal fold edge and the free parallel edge is slightly smaller than half the width of the top side of the box. When the closing flaps are folded down, the two free parallel edges of the two top closing flaps meet centrally and together form the top side of the external cardboard packaging. Having been closed in such a manner, the external cardboard packaging can then be secured, for example by an adhesive strip, in particular by an adhesive strip that is applied centrally and parallel to the fold edges of the top closing flaps on the top side of the external cardboard packaging and thus covers and/or connects the two free parallel edges of the top closing flaps with each other.

It can be alternatively provided that, for example, prior to the start of an advance movement of the folding devices, and thus prior to the start of the thereby caused folding in of the fold-in flaps, an application of an adhesive onto the inner sides of the top closing flaps is carried out. In the procedure of complete closing, for example by a below described, downward pressing closing device, the inside surfaces of the closing flaps are, in particular, pressed onto the outer surfaces of the fold-in flaps and in the process fixed thereto by the adhesive.

According to an alternative embodiment, it can be provided that a first top closing flap has a width between the horizontal fold edge and the free parallel edge that corresponds to maximally half of the width of the top side of the box between the two horizontal fold edges of the top closing flaps, while a second top closing flap has a width that corresponds approximately to the width of the top side of the box between the two horizontal fold edges of the top closing flaps. In the closing procedure by the above-mentioned method and/or by the above-mentioned apparatus, the second top closing flap forms the top side or, more precisely, the top side surface of the closed external cardboard packaging. In this alternative embodiment, an adhesive can be applied onto the outer surface of the first top closing flap, for example, prior to the folding-over procedure. Since the second top closing flap is at least in some areas disposed above the first top closing flap, an adhesive bond thus results between the first and the second top closing flap.

By folding in the fold-in flaps and by thereby causing the top closing flaps to fold down, a space between the first top closing flap and the first external cardboard packaging of the group and the second top closing flap of the second external cardboard packaging of the group is increased. In particular, a space between a free top parallel edge of the first top closing flap of the first external cardboard packaging of the group and a free top parallel edge of the second top closing flap of the second external cardboard packaging of the group is increased.

It is preferably provided that all of the at least two folding devices bear on, in each instance, an external cardboard packaging of the group bear on the fold-in flaps of all external cardboard packagings of the group simultaneously such that all top closing flaps of all external cardboard packagings of the group are folded down simultaneously and synchronously. It is provided, for example, that the folding devices are mechanically coupled with each other. It can be provided, for example, that one folding device is powered by a drive and that all other folding devices are likewise synchronously moved due to the mechanical coupling. The mechanical coupling in this context has to be designed such that the movement of a folding device in one direction causes a counter-movement of the associated oppositely located folding device that is bearing on the same external cardboard packaging. It can be alternatively provided that the folding devices are coupled electronically and controlled together electronically in order to cause a synchronous processing of all external cardboard packagings of a group. It is of course also possible that all folding devices each have an own drive, or that in each instance the at least two folding devices bearing on an external cardboard packaging and being advanceable toward each other are coupled with each other in terms of movement technology.

The external cardboard packagings forming a group can be secured on the transport device by fixing devices, in particular, such that a relative arrangement of the at least two external cardboard packagings of the group is defined. The fixing devices can be designed, in particular, as clamping devices between which the external cardboard packagings of the group are clamped such that the external cardboard packagings of the group are disposed edge to edge inside the transport device.

By pressing in the fold-in flaps by the folding devices, for example, by bars or the like that are advanceable toward each other, the top closing flaps of the external cardboard packagings are closed for the most part. The complete closing is preferably supported by a closing device that acts from above and, in particular, exerts a pressure onto the folded-down top closing flaps.

It can be provided that at the same time of the complete closing of the top closing flaps by the downward directed movement of the closing device, the folding devices are moved apart from each other and are thus removed from the engagement with the fold-in flaps.

According to one embodiment, the external cardboard packagings are moved continuously in a transport direction during the closing procedure. Accordingly, the folding devices are synchronously moved along in transport direction with the external cardboard packagings while they are engaged with the fold-in flaps. In the instance of a continuous transport movement of the external cardboard packagings, the closing device analogously thereto also has to be synchronously moved in transport direction while the top closing flaps of the external cardboard packagings are being pressed down.

According to an alternative embodiment, a cycled production operation is provided for, wherein the external cardboard packagings are moved in a transport direction, however, with the transport being at least briefly interrupted for the closing procedure of the external cardboard packagings, in particular in order to bring the folding devices into engagement with the fold-in flaps, and/or in order to finish the closing procedure by complete folding down of the top closing flaps, for example by the closing device.

Furthermore, it can be provided that the at least two external cardboard packagings of the group are transposed from the transport device onto a further transport lane or into a further packaging module after the closing procedure. According to one embodiment, the closing device can be appropriately designed so as to serve as transposing device at the same time such that the at least two external cardboard packagings of the group are closed completely and transposed onto a further transport lane or into a further packaging module by the closing device that acts from above. In particular, the closing device takes hold of all external cardboard packagings of a group simultaneously in order to close them completely and to transpose them together.

The invention describes a movement profile that is used to close a specifically designed RSC external cardboard packaging with quick-closing system at the top side. The external cardboard packaging is closed completely with the aid of a both-sided linear movement of the fold-in flaps toward each other, where the fold-in flaps have a special form with additional diagonal fold edges. By this method, a change of space between the top closing flaps of the external cardboard packaging is caused during the closing procedure.

This method has the advantage that a plurality of filled external cardboard packagings next to each other in a transport lane can be closed simultaneously. It is not possible to close at least two immediately adjacent boxes that are disposed edge to edge or only slightly spaced apart in the transport lane, by contrast, if customary methods are used, because each box has to be accessible from all four sides. With the compact arrangement of external cardboard packagings during closing, the apparatus requires less space and can thus be designed with smaller dimensions. In particular because the at least two external cardboard packagings can be closed simultaneously, it is moreover possible to realize a performance increase. In addition, the arrangement of the at least two external cardboard packagings contiguous to each other increases the stability of the external cardboard packagings inside the apparatus, because the external cardboard packagings support each other.

It is furthermore possible to process different quantities of bundles. The method and the apparatus can be used, in particular, for producing smaller bundles, that is, external cardboard packagings with fewer articles disposed therein, for example four-pack bundles or six-pack bundles.

Provided one of the top closing flaps is appropriately dimensioned, the use of external cardboard packagings with differently long top closing flaps allows a complete closing of the top side of the external cardboard packaging: In this instance, an application of glue, for example, onto only the inner side of the longer top closing flap and/or onto only the outer side of the shorter top closing flap, for example, can be sufficient for a secure fixation.

It should be explicitly mentioned at this point that all aspects and embodiment variants explained in the context of the apparatus according to the invention can likewise pertain to or constitute partial aspects of the method according to the invention. Specific aspects and/or interrelations and/or effects relating to the apparatus according to the invention referred to at some point in the present description or in the claims definitions therefore likewise pertain to the method according to the invention. The same applies conversely, so that all aspects and embodiment variants explained in the context of the method according to the invention can likewise pertain to or constitute partial aspects of the apparatus according to the invention. Specific aspects and/or interrelations and/or effects relating to the method according to the invention referred to at some point in the present description or in the claims definitions therefore likewise pertain to the apparatus according to the invention.

BRIEF DESCRIPTION OF THE FIGURES

In the following passages, the attached figures further illustrate exemplary embodiments of the invention and their advantages. The size ratios between the individual elements in the figures do not necessarily reflect the real size ratios. It is to be understood that in some instances various aspects of the invention may be shown exaggerated or enlarged in relation to other elements to facilitate an understanding of the invention.

FIGS. 3 to 6 show the closing procedure of an external cardboard packaging with quick-closing system by a folding apparatus according to the invention, with FIGS. 3A, 4A, 5A, and 6A each showing a lateral illustration, and with FIGS. 3B, 4B, 5B, and 6B each showing an illustration of the folding apparatus as seen along the transport direction; that is, the transport direction is perpendicular to the plane of the paper.

Figure 1B:
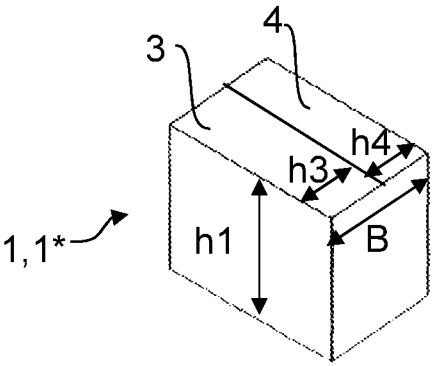
Fig. 1B (Prior Art)
FIGS. 1A and 1B show an external cardboard packaging with a quick-closing system.

The same or equivalent elements of the invention are designated using identical reference characters. Furthermore and for the sake of clarity, only the reference characters relevant for describing the individual figures are provided. It should be understood that the detailed description and specific examples of the embodiments of the apparatus or of the method according to the invention are intended for purposes of illustration only and are not intended to limit the scope of the invention.

DETAILED DESCRIPTION OF THE INVENTION

Figure 1A:
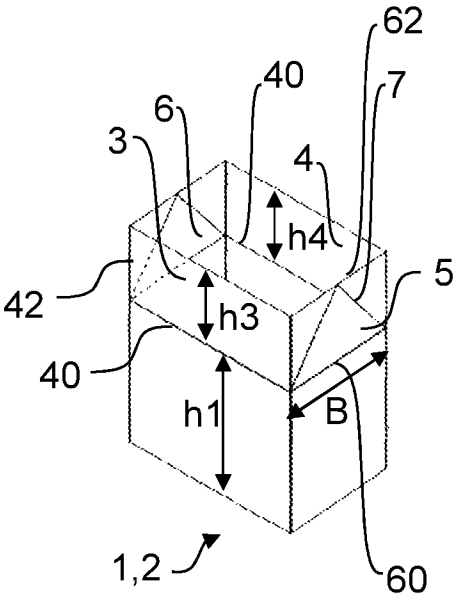
Fig. 1A (Prior Art)

FIGS. 1A and 1B show an external cardboard packaging 1 with a quick-closing system 2 in a perspective illustration. In particular, FIG. 1A shows an external cardboard packaging 1 that is open at the top, and FIG. 1B shows an external cardboard packaging 1 that is closed at the top, which is also indicated by the reference character 1* below. The external cardboard packaging 1 has a first top closing flap 3 and a second top closing flap 4, which closing flaps 3, 4 can be folded over approximately horizontal first fold edges 40. The side edges 42 of the top closing flaps 3, 4 are connected to each other via a first fold-in flap 5 and a second fold-in flap 6. In the illustrated example, the first top closing flap 3 and the second top closing flap 4 are designed to have identical dimensions and, in particular, to have the same lengths h3, h4, amounting in each instance to about 50% of the box width B. Furthermore, the first fold-in flap 5 and the second fold-in flap 6 are likewise designed to have identical dimensions and each have an approximately horizontal second fold edge 60 as well as third fold edges 7, which are formed, in particular, between the endpoints of the second horizontal fold edge 60 of the fold-in flaps 5, 6 and the center of the top free edge 62. When the first and the second closing flaps 3, 4 are folded down, the first and the second fold-in flaps 5, 6 are bent at these second and third fold edges 60, 7 such that the first and second fold-in flaps 5, 6 fold inward.

After the closing procedure, the closed external cardboard packaging 1* has a box height h1, which essentially corresponds to the height between the bottom side of the box and the top side of the box. The sum of the lengths h3, h4 of the closing flaps 3, 4 essentially adds up to the box width B. The sum of the lengths h3, h4 of the closing flaps 3, 4 is slightly less than the box width B in order to allow easy closing with little clearance.

Figure 2:
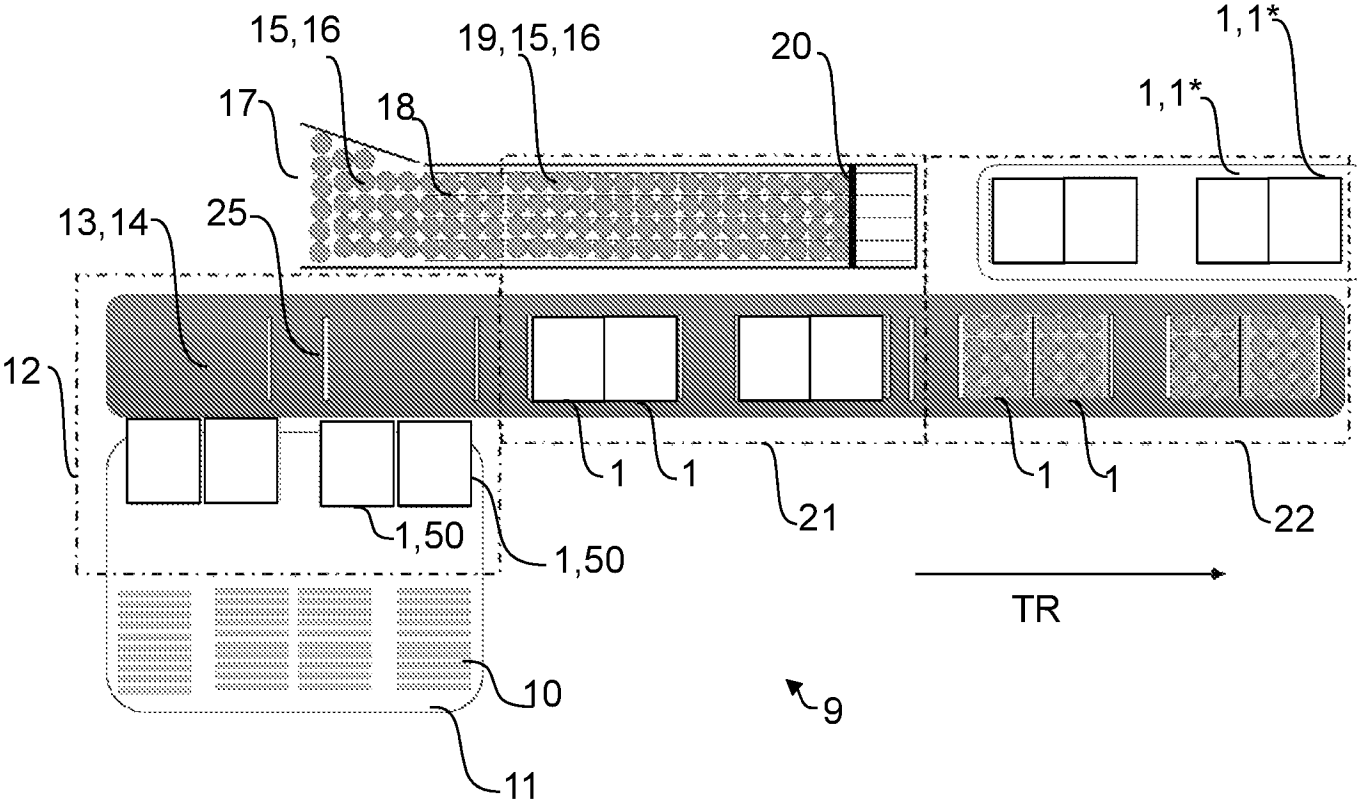
FIG. 2 shows an apparatus for the simultaneous filling and closing of at least two immediately adjacently disposed external cardboard packagings with quick-closing system.

FIG. 2 shows a packaging facility 9 for the simultaneous filling and closing of at least two immediately adjacently disposed external cardboard packagings 1 with quick-closing system 2 according to FIG. 1. Flat box blanks 10 are supplied in a magazine 11. The box blanks 10 are taken out by a robot or the like and are expanded to external cardboard packagings 1 in a first expanding apparatus 12, with the bottom flaps (not illustrated here) already being closed in the known manner. The suchlike prepared external cardboard packagings 1 are disposed on a first transport device 13, in particular, on a first conveyor belt 14, and are moved in transport direction TR. In this context, it is provided that in each instance at least two external cardboard packagings 1 are disposed as group 50 directly contiguous to each other on the first conveyor belt 14.

The articles 15, for example bottles 16, cans, or the like, to be placed into the external cardboard packagings 1 are fed in a mass flow, for example, via a bottle infeed 17, and are separated into parallel rows 19 by lane guides 18, for example, or by other suitable devices. In this context, the bottles 16 are preferably pressed against a stop 20 extending perpendicular to the lane guides 18. This results in a regular arrangement of the bottles 16 within the parallelly guided rows 19. Inside a packing module 21, an appropriate number of bottles 16 is withdrawn by a suitable gripping apparatus from the rows 18 and is placed into the prepared external cardboard packagings 1 on the conveyor belt 14. The gripping apparatus comprises so-called bell grippers, for example, used for picking up and setting down the bottles 16. The conveyor belt 14 can continue to move on without interruption while the bottles 16 are being placed into the external cardboard packagings 1. In this instance, however, the gripping apparatus has to be moved along synchronously therewith. A cyclic operation is alternatively conceivable, that is to say that the conveyor belt 14 is briefly stopped, the bottles 16 are placed into the external cardboard packagings 1, and the conveyor belt 14 is restarted in order to feed the external cardboard packagings 1, now filled with bottles 16, to an apparatus, in particular to a folding apparatus 22, in order to close the top sides of the external cardboard packagings 1. Inside the folding apparatus 22, which is to be described in more detail below in the context of FIGS. 3 to 10, the top first and second closing flaps 3, 4 are folded down and the external cardboard packaging 1 is closed. The closed external cardboard packaging 1 is also indicated by the reference character 1* below.

FIGS. 3 to 6 show the closing procedure for an external cardboard packaging 1 with a quick-closing system 2 by a folding apparatus 22 according to the invention, with FIGS. 3A, 4A, 5A, and 6A each showing a lateral illustration and with FIGS. 3B, 4B, 5B, and 6B each showing an illustration of the folding apparatus as seen in transport direction. The illustrated external cardboard packagings 1 according to FIG. 1 have identically dimensioned first and second closing flaps 3, 4.

A movement profile for the closing procedure of an external cardboard packaging 1 is, in particular, illustrated by FIGS. 3 to 6. The external cardboard packagings are set down, in each instance as group 50 comprising at least two external cardboard packagings 1-1, 1-2, on the first transport device 13 and are fixed there, preferably between two clamping devices 25 arranged successively in transport direction TR and movable in transport direction TR together with the first transport device 13. The at least two external cardboard packagings 1-1, 1-2 of the group 50 are thus disposed directly contiguous to each other or only slightly spaced apart from each other, with a first top closing flap 3-1 of a first external cardboard packaging 1-1 adjoining a second closing flap 4-2 of the second external cardboard packaging 1-2. It is therefore not possible to simply use a customarily known closing procedure by pressing down the top closing flaps 3-1, 3-2, 4-1, 4-2.

While the external cardboard packagings 1-1, 1-2 are being filled with articles (not illustrated here) and are being fed to the folding apparatus 22 via the first transport device 13, they are fastened to the first transport device 13 by the clamping device 25.

The folding apparatus 22 comprises linear movable folding devices 23. In particular, the folding apparatus 22 has two folding devices 23, for example linear tappets 24, that are advanceable toward each other for each of the external cardboard packagings 1-1, 1-2 to be closed simultaneously. The folding devices 23 are disposed on both sides of the first transport device 13, and they are, in particular, designed to be linearly movable orthogonal to the transport direction TR. The folding devices 23 are thus disposed, in particular, parallel to the top closing flaps 3-1, 3-2, 4-1, 4-2. The folding devices 23 are disposed, in particular, above the transport surface of the first transport device at a height h22 that is at least slightly greater than the box height h1 and that is less than the sum of box height h1 and length h3, h4 of the closing flaps 3, 4.

In order to close the external cardboard packagings 1-1, 1-2 of a group 50, the folding devices 23 arranged in pairs and associated with the particular external cardboard packaging 1-1, 1-2 are at the same time advanced toward each other by a linear movement (FIGS. 4 and 5). This causes the fold-in flaps 5, 6 to fold in, thus automatically leading to the free top parallel edges 30 of the top closing flaps 3-1, 4-1 and 3-2, 4-2 of each external cardboard packaging 1-1, 1-2 to be moved downward and toward each other. In contrast to the external cardboard packaging 1 illustrated in FIG. 1, the fold-in flaps 5, 6 of the external cardboard packagings 1 according to the exemplary embodiment illustrated in FIGS. 3 to 6 have a trapezoidal recess 8 in the central section of their top free edge (see FIG. 3A). The third fold edges 7 are formed, in particular, between the bottom corners of the trapezoidal recess 8 and the corners of the horizontal second fold edge 60 resulting in fold-in flaps 5, 6 that are also trapezoidal. The folding devices 23, in particular the linear tappets 24, preferably bear on, in a central section of, the fold-in flaps 5, 6 below the trapezoidal recess 8 and, by their movement directed toward the center of the external cardboard packaging 1, they cause the fold-in flaps 5, 6 to fold in over the second fold edges 60 and the top closing flaps 3-1, 4-1 and 3-2, 4-2 to fold down over the first fold edges 40 (see FIG. 3A).

In the process, the space A30 between the free top parallel edges 30 of the top closing flap 3-1 and of the top closing flap 4-1 of the external cardboard packaging 1-1 is reduced. The space between the free top parallel edges 30 of the top-closing flap 3-2 and of the top closing flap 4-2 of the external cardboard packaging 1-2 is analogously reduced. By folding down the top closing flaps 3-1, 3-2, 4-1, 4-2, a space d then moreover results between the first top closing flap 3-1 of the first external cardboard packaging 1-1 and the second closing flap 4-2 of the second external cardboard packaging 1-2.

According to FIG. 5B, a closing device 26 can be positioned from above onto the external cardboard packagings 1 in order to close the to the most part downward folded top closing flaps 3-1, 3-2, 4-1, 4-2 completely. The closing device 26 is preferably designed such that it is positioned simultaneously onto the at least two external cardboard packagings 1-1, 1-2 gathered together in a group 50 and the external cardboard packagings 1-1, 1-2 are thus finished synchronously. At the same time, the folding devices 23 associated with the particular external cardboard packagings 1-1, 1-2 are moved apart according to FIG. 6B such that they are no longer engaged with the fold-in flaps 5, 6 of the external cardboard packagings 1-1, 1-2.

Furthermore, it can be provided that, prior to the start of an advance movement of the folding devices 23, and thus prior to the start of the thereby caused folding in of the fold-in flaps 5, 6, an application of an adhesive onto the inner sides of the top closing flaps 3-1, 3-2, 4-1, and/or 4-2 is carried out. In the procedure of complete closing by the downward pressing closing device 26, the inside surfaces of the closing flaps 3-1, 3-2, 4-1, and/or 4-2 are, in particular, pressed onto the outer surfaces of the fold-in flaps 5, 6 and in the process fixed thereto by the adhesive. Alternatively, an adhesive strip can be applied over the abutting edge of the centrally adjoining closing flaps 3-1, 4-1 or 3-2, 4-2 and in this manner connect the abutting edges to each other and to thus close the top side of the external cardboard packaging 1, 1*.

It can furthermore be provided that the at least two external cardboard packagings 1-1, 1-2 of the group 50 are transposed from the transport device 13 onto a further transport lane or into a further packaging module after the closing procedure. The closing device 26 can be appropriately designed, for example, to serve as transposing device 28 at the same time, such that the at least two external cardboard packagings 1-1, 1-2 of the group 50 are closed completely and transposed onto a further transport lane or into a further packaging module by the closing device 26 that acts from above. In particular, the closing device 26 takes hold of all external cardboard packagings 1-1, 1-2 of the group 50 simultaneously in order to close them completely and to transpose them together.

Figure 9:
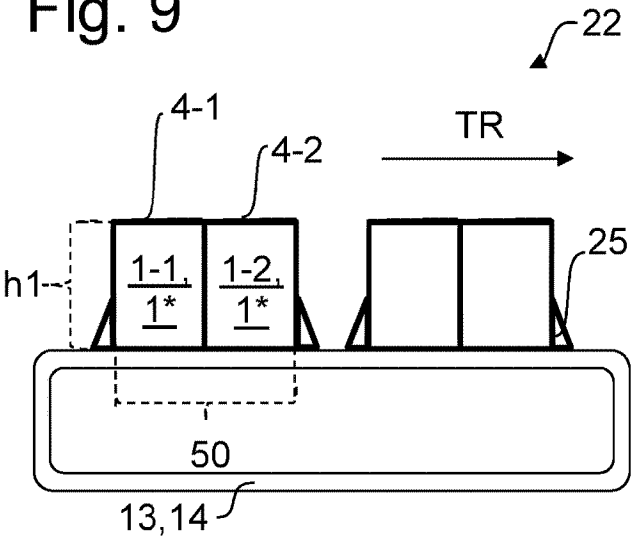
FIGS. 7 to 10 show the closing procedure of a further embodiment of an external cardboard packaging with quick-closing system by a folding apparatus according to the invention.
Figure 10:
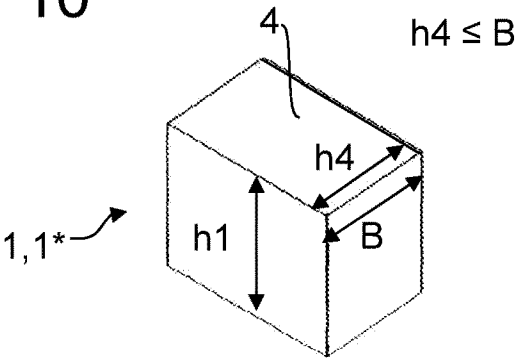
Figure 7:
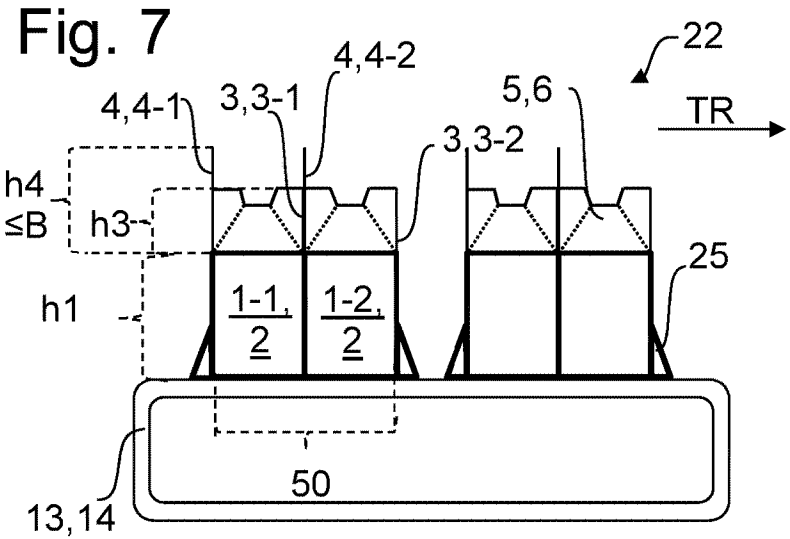
Figure 8:
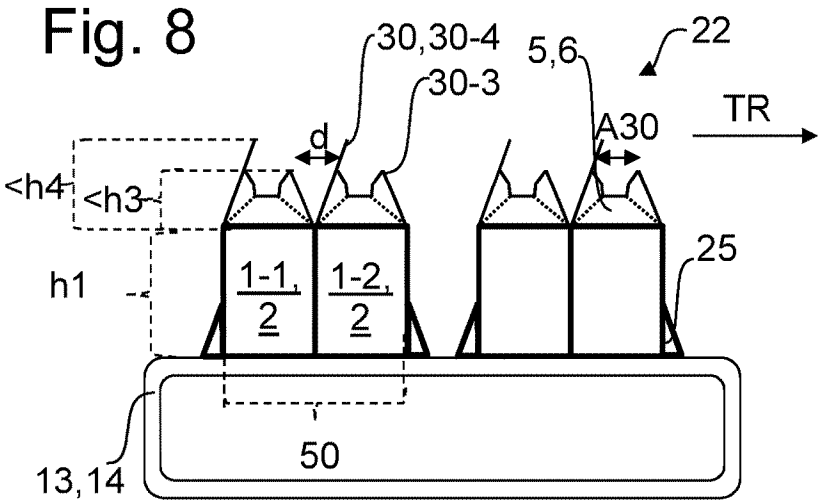

FIGS. 7 to 10 show the closing procedure of a further embodiment of an external cardboard packaging 1, 1-1, 1-2 with quick-closing system by a folding apparatus 22 according to the invention, with FIGS. 7 to 9 each showing a lateral illustration of the folding apparatus 22. FIG. 10 shows a perspective illustration, in particular, of the closed external cardboard packaging 1* produced in this process.

The first closing flap 3, 3-1, 3-2 of the embodiment of an external cardboard packaging 1, 1-1, 1-2 illustrated here has a length of h3, which is less than the box width B (see also FIG. 1). The second closing flap 4, 4-1, 4-2, by contrast, has a length of h4, which is greater than the length h3 and approximately corresponds to the box width B; in particular, h4≤B applies.

Again, the external cardboard packagings are set down, in each instance as group 50 comprising at least two external cardboard packagings 1-1, 1-2, on the first transport device 13 and are fixed there, preferably between two clamping devices 25 arranged successively in transport direction TR and movable in transport direction TR together with the first transport device 13. Regarding the folding procedure by the folding devices 23, the description for FIGS. 3 to 6 is referred to.

The folding devices 23 are disposed, in particular, above the transport surface of the first transport device 13 at a height h22 that is at least slightly greater than the box height h1 and less than the sum of box height h1 and length h3 of the shorter closing flap 3.

In order to close the external cardboard packagings 1-1, 1-2 of a group 50, the folding devices 23 arranged in pairs and associated with the particular external cardboard packaging 1-1, 1-2 are advanced toward each other at the same time by a linear movement (FIGS. 4 and 5). This causes the fold-in flaps 5, 6 to fold in, thus automatically leading to the free top parallel edges 30-3, 30-4 of the top closing flaps 3-1, 4-1 and 3-2, 4-2 of each external cardboard packaging 1-1, 1-2 to be moved downward and toward each other. By folding down the top closing flaps 3-1, 3-2, 4-1, 4-2, a space d then moreover results between the first top closing flap 3-1 of the first external cardboard packaging 1-1 and the second closing flap 4-2 of the second external cardboard packaging 1-2.

In FIG. 10, a closed external cardboard packaging 1* produced according to FIGS. 7 to 9 is shown in a perspective illustration. With the length h4 preferably corresponding approximately to the box width B or being slightly less than the box width B, the outer side of the closing flap 4 essentially forms the top side of the closed external cardboard packaging 1*.

Provided one of the top closing flaps 4, 4-1, 4-2 is appropriately dimensioned, the use of external cardboard packagings 1 with differently long top closing flaps 3, 4 thus allows a complete closing of the top side of the external cardboard packaging 1, 1*. In such an instance, an application of glue, for example, onto only the inner side of the longer top closing flap 4, 4-1, 4-2 and/or onto only the outer side of the shorter top closing flap 3, 3-1, 3-2, for example, can be carried out in order to securely close or fix the top side of the external cardboard packaging 1, 1*.

The method for the box-closing procedure described here and the folding apparatus 22 have the advantage that a plurality of external cardboard packagings 1 next to each other can be closed simultaneously, whereby it is in particular possible to realize a performance increase. Depending on the external cardboard packagings 1 being potentially filled with different articles or also depending on different external cardboard packagings being used within a group 50 of boxes to be closed simultaneously, it is possible to process different types of bundles at the same time.

It can be provided to dispose the folding devices 23 of the folding apparatus 22 height-variably such that the height h22, where the folding devices 23 are disposed above the transport level of the first transport device 13 in a linearly movable manner at a level parallel to the transport level, can be adapted and adjusted corresponding to the box height h1 of the particular external cardboard packaging 1. The folding apparatus 22 is thus variably usable. The variability can be increased further if the clamping devices 25 are disposed on the first transport device 13 in such a manner that the space between the clamping devices 25, between which the external cardboard packagings 1 of a group 50 are in each instance arranged, can likewise be changed.

The embodiments, examples, and alternatives of the preceding paragraphs, the claims, or the following figures and description, including any of their various aspects or respective individual features, may be taken independently or in any combination. Features described in connection with one embodiment are applicable to all embodiments, unless such features are incompatible.

If illustrations and aspects are generally referred to as being "schematic" in the context of the figures, this is by no means intended to imply that the illustration of the figures and their description are of inferior significance with regard to the disclosure of the invention. The person skilled in the art is fully capable of gathering sufficient information from the schematically and abstractly drawn illustrations for facilitating the understanding of the invention, without the understanding being in any way impaired, for example, by the potentially not precisely true-to-scale size ratios of the illustrated external cardboard packaging and/or of parts of the folding apparatus or of other illustrated elements. On the basis of the more concretely explained realizations of the method according to the invention and on the basis of the more concretely explained functionality of the folding apparatus according to the invention in the figures, the person skilled in the art as a reader is thus enabled to derive a better understanding of the inventive idea, which is formulated in a more general and/or more abstract manner in the claims and in the general part of the description.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE CHARACTERS

1 External cardboard packaging
1* Closed external cardboard packaging
2 Quick-closing system
3 First top closing flap
4 Second top closing flap
5 First fold-in flap
6 Second fold-in flap
7 Third fold edge
8 Trapezoidal recess
9 Packaging facility
10 Box blanks
11 Magazine
12 Expanding apparatus
13 First transport device
14 First conveyor belt
15 Article
16 Bottle
17 Bottle infeed
18 Lane guide
19 Row
20 Stop
21 Packing module
22 Folding apparatus
23 Folding device
24 Linear tappet
25 Fixing Device/Clamping device
26 Closing device
28 Transposing device
30 Free top parallel edge of a top closing flap
40 First fold edge
42 Side edge between top closing flap and fold-in flap
50 Group of at least two external cardboard packagings
60 Second fold edge
62 Top free edge
A30 Space between free top parallel edges of the top closing flaps of an external cardboard packaging
B Box width
d Space between a first top closing flap of a first external cardboard packaging and a second top closing flap of a second external cardboard packaging
h1 Box height
h22 Height
h3, h4 Length of the closing flaps
TR Transport direction

The invention claimed is:

1. A method for closing a top side of external cardboard packagings (1), the method comprising:

positioning at least two external cardboard packagings (1) as a group (50) directly contiguous to each other and disposed edge to edge on a transport device (13) such that a first top closing flap of a first external cardboard packaging (1) of the group (50) is located contiguous to or slightly spaced apart from a second top closing flap of a second external cardboard packaging (1) of the group (50), wherein each external cardboard packaging comprises two top closing flaps (3, 4) located opposite each other and foldable over horizontal first fold edges (40), with side edges (42) of the closing flaps (3, 4) in each instance being connected to each other via two fold-in flaps (5, 6), wherein the fold-in flaps (5, 6) each comprise horizontal second fold edges (60) and third fold edges (7) formed diagonal to the second fold edges, and pressing in the fold-in flaps (5, 6) of each of the at least two external cardboard packagings (1) of the group (50) with at least two folding devices (23) that are advanceable toward each other and folding the fold-in flaps (5, 6) on their respective second fold edges (60) and third fold edges (7), causing the top closing flaps (3, 4) to fold down, wherein the pressing in step increases a space (d) between the first top closing flap of the first external cardboard packaging (1) of the group (50) and the second top closing flap of the second external cardboard packaging (1) of the group (50), and wherein the folding devices (23) simultaneously press in the fold-in flaps (5, 6) of each of the at least two external cardboard packagings (1) of the group (50).

2. The method of claim 1, further comprising pressing down on the top closing flaps (3, 4) of the external cardboard packagings (1) from above with a closing device (26).

3. The method of claim 2, further comprising moving the folding devices (23) apart from each other during the pressing down step.

4. The method of claim 3, further comprising continuously moving the external cardboard packagings (1) in a transport direction TR during the pressing in step and/or the pressing down step.

5. The method of claim 4, further comprising synchronously moving the folding devices (23) in the transport direction TR with the external cardboard packagings (1) during the pressing in step, and/or synchronously moving the closing device (26) in the transport direction TR with the external cardboard packagings (1) during the pressing down step.

6. The method of claim 3, further comprising briefly interrupting the movement of the external cardboard packagings (1) in a transport direction TR, in order to carry out the pressing in step and/or the pressing down step.

7. The method of claim 2, further comprising transposing the at least two external cardboard packagings (1) of the group (50), after they are completely closed, onto a further transport lane or into a further packaging module.

8. The method of claim 1, wherein the pressing in step comprises pressing in on trapezoidal fold-in flaps (5, 6).

9. The method of claim 1, wherein the at least two folding devices (23) are linearly movable transversely to a transport direction TR of the transport device (13).

10. The method of claim 1, further comprising securing the at least two external cardboard packagings (1) on the transport device (13) with fixing devices (25) such that the at least two external cardboard packagings (1) of the group (50) are disposed edge to edge.

11. The method of claim 10, wherein the fixing devices (25) are clamping devices arranged successively in a transport direction (TR) and are movable in the transport direction (TR) with the transport device (13).

* * * * *